US005468884A

United States Patent [19]

Eckhardt

[11] Patent Number: 5,468,884

[45] **Date of Patent: * Nov. 21, 1995**

[54] LIQUID DETERGENT COMPOSITIONS

[75] Inventor: Claude Eckhardt, Riedisheim, France

[73] Assignee: Ciba-Geigy Corporation, Ardsley, N.Y.

[ * ] Notice: The portion of the term of this patent subsequent to Jan. 18, 2011, has been disclaimed.

[21] Appl. No.: 152,331

[22] Filed: Nov. 12, 1993

[30] Foreign Application Priority Data

Nov. 17, 1992 [CH] Switzerland ..... 3528/92

[51] Int. Cl.[6] ..... C11D 1/83

[52] U.S. Cl. ..... 549/437; 252/558; 252/89.1; 252/559; 252/542; 252/99; 252/95; 252/96; 252/98; 252/102; 8/648

[58] Field of Search ..... 252/558, 89.1, 252/559, 542, 99, 96, 95, 98, 102; 549/437; 8/648

[56] References Cited

U.S. PATENT DOCUMENTS

| | | | |
|---|---|---|---|
| 3,929,678 | 12/1975 | Laughlin | 252/526 |
| 4,002,423 | 1/1977 | Sahm | 8/1 |
| 4,284,532 | 8/1981 | Leikhim | 252/528 |
| 4,285,841 | 8/1981 | Barrat | 252/559 |
| 4,321,165 | 3/1982 | Smith | 252/528 |
| 4,507,219 | 3/1985 | Hughes | 252/118 |
| 5,139,695 | 8/1992 | Eckhardt | 252/187 |
| 5,279,772 | 1/1994 | Eckhardt | 252/558 |

FOREIGN PATENT DOCUMENTS

| | | |
|---|---|---|
| 0167205 | 1/1986 | European Pat. Off. . |
| 0293040 | 11/1988 | European Pat. Off. . |
| 0364027 | 4/1990 | European Pat. Off. . |
| 0394998 | 10/1990 | European Pat. Off. . |
| 0548019 | 6/1993 | European Pat. Off. . |
| 3900651 | 7/1989 | Germany . |
| 2141754 | 1/1985 | United Kingdom . |
| 9206172 | 4/1992 | WIPO . |

*Primary Examiner*—Richard L. Raymond
*Assistant Examiner*—Brian M. Burn
*Attorney, Agent, or Firm*—Kevin T. Mansfield

[57] ABSTRACT

The invention describes novel highly concentrated, aqueous liquid detergent compositions comprising a) 0.01 to 2% by weight of dibenzofuranyl biphenyls of formula (1)

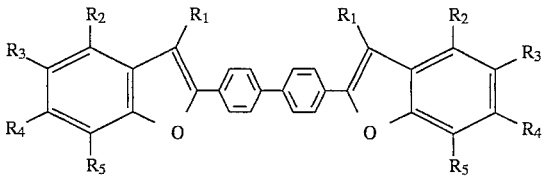

(1)

wherein $R_1$, $R_2$, $R_3$, $R_4$ and $R_5$ are each independently of one another a sulfonic acid radical, hydrogen, $C_1$–$C_4$alkyl, $C_1$–$C_4$alkoxy, halogen, CN, phenoxy or benzyloxy, with the proviso that only one of $R_1$ to $R_5$ is a sulfonic acid radical, b) 6 to 22% by weight of water, based on the weight of the detergent composition, and c) suffactants, and to their preparation and use for pretreating and washing textile fabrics.

19 Claims, No Drawings

LIQUID DETERGENT COMPOSITIONS

The present invention relates to novel highly concentrated aqueous and liquid detergent compositions containing specific disulfonated dibenzofuranyl biphenyls as fluorescent whitening agents, to their preparation and to the use thereof.

It is common practice to use fluorescent whitening agents in liquid detergent compositions. During treatment they exhaust on to the material to be washed and, by virtue of their special light absorption/emission properties, they induce elimination of yellowing or enhancement of the degree of whiteness.

This effect, however, is also responsible for the occurrence of bleach spots when textile fabric comes into direct contact with the concentrated liquid detergent composition, as in a pretreatment. To solve this problem, EP-A-167 205 postulates the use of monosulfonated stilbene triazolyl, stilbene triazine or distyrylbiphenyl fluorescent whitening agents in anionic liquid detergents.

The trend to increasingly more concentrated detergent formulations, however, also makes exacting demands of the individual components with respect to ease of incorporation, solubility and storage stability. Liquid detergent compositions having a water content of 25–65% by weight are disclosed in EP-A-394 998.

Surprisingly, it has now been found that highly concentrated, aqueous liquid detergent compositions comprising a) 0.01 to 2% by weight and, preferably, 0.02 to 0.4% by weight, based on the weight of the detergent composition, of one or more than one disulfonated fluorescent whitening agent of formula (1)

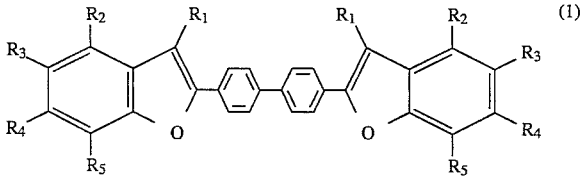

wherein $R_1$, $R_2$, $R_3$, $R_4$ and $R_5$ are each independently of one another a sulfonic acid radical, hydrogen, $C_1$–$C_4$alkyl, $C_1$–$C_4$alkoxy, halogen, CN, phenoxy or benzyloxy, with the proviso that only one of $R_1$ to $R_5$ is a sulfonic acid radical, b) 6 to 22% by weight and, preferably, 8 to 17% by weight, of water, based on the weight of the detergent composition, and c) surfactants, have excellent storage stability and no tendency to cause spotting.

Suitable halogens are preferably fluoro, chloro and bromo. Chloro is most preferred.

$C_1$–$C_4$Alkyl radicals are suitably unbranched or branched alkyl radicals, typically methyl, ethyl, n-propyl, isopropyl, n-butyl and tert-butyl. $C_1$–$C_4$Alkoxy radicals are suitably unbranched or branched alkoxy radicals, typically methoxy, ethoxy, n-propoxy, isopropoxy, n-butoxy and tert-butoxy. These alkyl and alkoxy radicals may in turn be substituted by e.g. aryl (phenyl or naphthyl), $C_1$–$C_4$alkyl (methyl, ethyl, n-propyl, isopropyl, n-butyl or tert-butyl), $C_1$–$C_4$alkoxy (methoxy, ethoxy, n-propoxy, isopropoxy, n-butoxy or tert-butoxy), OH— or —CN groups.

Preferred dibenzofuranyl biphenyls of formula (1) are those wherein $R_1$=$SO_3M$;

$R_2$, $R_3$, $R_4$ and $R_5$ are each independently of one another hydrogen, $C_1$–$C_4$alkyl, $C_1$–$C_4$alkoxy, halogen, CN, phenoxy or benzyloxy, preferably hydrogen, methyl, ethyl, isopropyl, tert-butyl, methoxy, chloro, CN, phenoxy or benzyloxy, most preferably methyl, ethyl, isopropyl, tert-butyl or chloro; and M=is hydrogen or a non-chromophoric cation; as well as compounds of formula (1), wherein $R_1$=hydrogen, $C_1$–$C_4$alkyl, $C_1$–$C_4$alkoxy, halogen, CN, phenoxy or benzyloxy; $R_2$, $R_3$, $R_4$ and $R_5$ are each independently of one another $SO_3M$, hydrogen, $C_1$–$C_4$alkyl, $C_1$–$C_4$alkoxy, halogen, CN, phenoxy or benzyloxy, preferably $SO_3M$, hydrogen, methyl, ethyl, isopropyl, tert-butyl, methoxy, chloro, CN, phenoxy or benzyloxy, most preferably $SO_3M$, hydrogen, methyl, ethyl, isopropyl, tert-butyl or chloro, with the proviso that only one of $R_2$ to $R_5$ is a sulfonic acid radical; and M=hydrogen or a non-chromophoric cation.

Among these preferred dibenzofuranyl biphenyls, those compounds of formula (1) are especially preferred, wherein $R_4$=$SO_3M$, $R_1$, $R_2$, $R_3$ and $R_5$ are each independently of one another hydrogen, C–$C_4$alkyl, $C_1$–$C_4$alkoxy, halogen, CN, phenoxy or benzyloxy, preferably hydrogen, methyl, ethyl, isopropyl, tert-butyl, methoxy, chloro, CN, phenoxy or benzyloxy, most preferably hydrogen, methyl, ethyl, isopropyl, tert-butyl or chloro; and M=hydrogen or a non-chromophoric cation; as well as compounds of formula (1), wherein $R_2$=$SO_3M$ $R_1$, $R_3$, $R_4$ and $R_5$ are each independently of one another hydrogen, C–$C_4$alkyl, $C_1$–$C_4$alkoxy, halogen, CN, phenoxy or benzyloxy, preferably hydrogen, methyl, ethyl, isopropyl, tert-butyl, methoxy, chloro, CN, phenoxy or benzyloxy, most preferably hydrogen, methyl, ethyl, isopropyl, tert-butyl or chloro; and M=hydrogen or a non-chromophoric cation.

M having the significance of a non-chromophoric cation is preferably an alkali metal such as lithium, sodium, potassium as well as ammonium or substituted ammonium, typically ammonium, mono-, di- or triethanolammonium, mono-, di- or tripropanolammonium or tri- or tetramethylammonium. Sodium, potassium and ammonium are especially preferred.

Liquid detergent compositions will be understood as comprising the known and commercially available detergent compositions disclosed, inter alia, in EP-A- 167 205 or U.S. Pat. No. 4,507,219 or EP-A-293 040.

Suitable surfactants may be anionic, nonionic, cationic or zwitterionic surfactants.

The formulation may typically comprise:

0 to 40% by weight, preferably 2 to 10% by weight, of anionic surfactants, 3 to 78% by weight, preferably 10 to 60% by weight, of non-ionic surfactants, 3 to 35% by weight, preferably 5 to 25% by weight, of ethoxylation products, 0.5 to 35% by weight, preferably 1 to 20% by weight, of builders, 0 to 10% by weight, preferably 1 to 8% by weight, of zwitterionic surfactants, 0 to 3% by weight, preferably 0.7 to 2% by weight, of cationic surfactants, and 0 to 15% by weight, preferably 0.2 to 10% by weight, of polymers.

Useful surfactants are described, inter alia, in U.S. Pat. No. 4,285,841, U.S. Pat. No. 3,929,678 and U.S. Pat. No.

4,284,532. It is especially preferred to use the surfactants designated as preferred in EP-A-167 205.

Anionic surfactants may also be fatty acids such as saturated and unsaturated carboxylic acids, including oleic acid, capric acid, myristic acid, coconut and palm kernel fatty acid, or the salts thereof;

alkyl sulfates;

the alkyl sulfonates disclosed in GB-A-2 141 754, e.g. sodium pentadecylsulfonate or dioctyl ether sulfosuccinate and, preferably, the $C_9$–$C_{15}$alkylbenzenesulfonates;

the alkyl phosphonates or alkyl polyphosphonates disclosed, inter alia, in U.S. Pat. No. 4,321,165.

Non-ionic surfactants include the polyhydroxy fatty acid amides disclosed in WO 92/06172 and alkyl phenols. Further suitable non-ionic surfactants are also the alkyl polyglucosides of $C_9$–$C_{15}$salkylene containing 1–10 glucoside units, typically nonyl glucoside and allyl($C_{12}$–$C_{15}$)poly(1–10)glucoside, sorbitan esters such as polyoxyethylene sorbitan monopalmitate, fatty acid ethanolamides such as coconut fatty acid diethanolamide and fatty acid ethanolamine oxides such as tetradecylamine oxide.

The ethoxylation products are conveniently obtained by condensation of ethylene oxide and/or propylene oxide with a hydrocarbon that carries an active hydrogen atom, for example:

a low molecular aliphatic polyol, a saturated and/or unsaturated fatty alcohol of 8 to 22 carbon atoms, an alkyl phenol containing 4 to 12 carbon atoms in the alkyl moiety, a hydroxybiphenyl, a saturated and/or unsaturated fatty amine of 8 to 22 carbon atoms, a saturated and/or unsaturated fatty acid of 8 to 22 carbon atoms, or a saturated and/or unsaturated fatty acid (N,N-bishydroxyalkyl)amide, such that preferably 3 to 100 mol of ethylene oxide and/or propylene oxide are present per 1 mol of the cited compounds. Typical examples are the alcohol ethoxylates. It is, however, also possible to use mixtures of these reaction products with one another. These mixtures are obtained by mixing the individual reaction products or directly by ethoxylation of a mixture of the compounds from which the reaction products are derived.

Suitable detergent builders or polymers are conveniently the preferably polycarboxylated compounds cited in U.S. Pat. No. 4,321,165 and U.S. Pat. No. 4,284,532, including citric acid or maleic acid/acrylic acid copolymers, as well as the ligninsulfonates, formaldehyde adducts, polyethylene glycols, polyvinyl pyrrolidones, polyvinyl imidazoles, and Al/Mg silicates.

Zwitterionic surfactants are typically aminocarboxylic acids and alkylamine oxides.

Cationic surfactants are typically quaternary ammonium or amine compounds.

The formulation may also comprise 1 to 10% of customary detergent additives such as enzymes, enzyme stabilisers, antioxidants, preservatives and disinfectants, emulsifiers, thickeners, foam regulators, stabilisers, antiredeposition agents, perfumes and dyes, complex formers or sequestrants, and solvents.

Suitable salts that may be used are typically formates, acetates and sodium chloride.

Liquid detergent compositions containing specifically sulfonated dibenzofuranyl biphenyls may also comprise, as also described in EP-A-293 040, up to 20% by weight of one or more than one bleaching agent such as phthalocyanines, peracids such as perborates or diperoxydicarboxylic acids, or peracid precursors as well as peracid activators or peracid catalysts.

The formulation is prepared by mixing the components with stirring. The formulation so obtained is stable for months and does not form a sediment.

The preparation of the fluorescent whitening agents used is disclosed, inter alia, in EP-A-394 998.

The invention is illustrated by the following Examples in which parts and percentages are by weight. The spotting test is carried out as follows:

a) whitener/detergent formulation: 0.1% (100% of active substance) of fluorescent whitening agent or mixture thereof is dissolved in a liquid detergent. 7.5 g of this whitener containing detergent (A) are diluted with water (10°–12° dH) at a temperature of 30° C. to 1000 ml (wash liquor B).

b) A 20 g piece of bleached cotton fabric is clamped on a stenter frame.

c) 0.6 ml of detergent solution (A) is applied uniformly with a pipette to a premarked round area (5 cm diameter) of this cotton fabric which, after a treatment time of 30 seconds, is put into the prepared wash liquor (B) and washed for 15 minutes at 60° C. The cotton fabric is then rinsed with cold water and dried at 70° C.

d) The difference in the degree of whiteness according to Ganz between the treated area and the surrounding area is a measure of the so-called spotting behaviour (formation of bleach spots) and is determined by inspecting the textile fabric with a Zeiss RFC3 photometer.

Example 1

The following components are mixed, with stirring, at 60° C.:

40 parts of $C_{12}$–$C_{15}$polyethoxy fatty alcohol (7 EO)
15 parts of polyethylene glycol 200
10 parts of ethanol
5 parts of propanediol
3.9 parts of triacetine
5 parts of triethanolamine
5 parts of phosphonate
16 parts of deionised water
and 0.1 pan of the fluorescent whitening agent of formula (2)

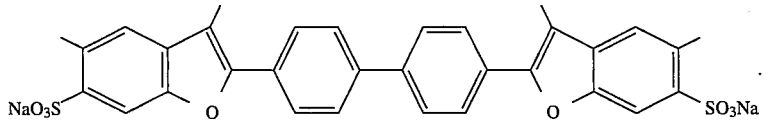

(2)

A slightly turbid, storage-stable detergent composition is obtained.

Example 2

The procedure described in Example 1 is repeated, but using a fluorescent whitening agent of formula (3)

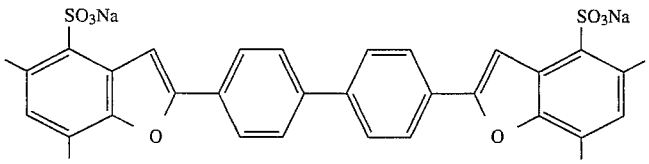

(3)

Examples 3 and 4

The detergent compositions obtained in Examples 1 and 2 are used in a concentration of 7.5 g/l to wash bleached cotton at 60° C. After rinsing and drying, high degrees of whiteness are obtained with negligible spotting.

What is claimed is:

1. A highly concentrated, aqueous liquid detergent composition comprising a) 0.01 to 2% by weight, based on the weight of the detergent composition, of one or more than one disulfonated fluorescent whitening agent of formula (1)

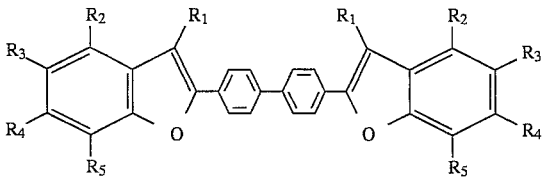

(1)

wherein $R_1$, $R_2$, $R_3$, $R_4$ and $R_5$ are each independently of one another a sulfonic acid radical, hydrogen, $C_1$–$C_4$alkyl, $C_1$–$C_4$alkoxy, halogen, CN, phenoxy or benzyloxy, with the proviso that only one of $R_1$ to $R_5$ is a sulfonic acid radical, b) 6 to 22% by weight of water, based on the weight of the detergent composition, and c) one or more surfactants.

2. A liquid detergent composition according to claim 1, which comprises a fluorescent whitening agent of formula (1), wherein $R_1$=$SO_3M$;

M=is hydrogen or a non-chromophoric cation; and $R_2$, $R_3$, $R_4$ and $R_5$ are each independently of one another hydrogen, $C_1$–$C_4$alkyl, $C_1$–$C_4$alkoxy, halogen, CN, phenoxy or benzyloxy.

3. A liquid detergent composition according to claim 2, which comprises a fluorescent whitening agent of formula (1), wherein $R_1$=$SO_3M$;

M=is hydrogen or a non-chromophoric cation; and $R_2$, $R_3$, $R_4$ and $R_5$ are each independently of one another hydrogen, methyl, ethyl, isopropyl, tert-butyl, methoxy, chloro, CN, phenoxy or benzyloxy.

4. A liquid detergent composition according to claim 3, which comprises a fluorescent whitening agent of formula (1), wherein $R_1$=$SO_3M$;

M=is hydrogen or a non-chromophoric cation; and $R_2$, $R_3$, $R_4$ and $R_5$ are each independently of one another hydrogen, methyl, ethyl, isopropyl, tert-butyl or chloro.

5. A liquid detergent composition according to claim 1, which comprises a fluorescent whitening agent of formula (1), wherein $R_1$=hydrogen, $C_1$–$C_4$alkyl, $C_1$–$C_4$alkoxy, halogen, CN, phenoxy or benzyloxy;

$R_2$, $R_3$, $R_4$ and $R_5$ are each independently of one another $SO_3M$, hydrogen, $C_1$–$C_4$alkyl, $C_1$–$C_4$alkoxy, halogen, CN, phenoxy or benzyloxy, with the proviso that only one of $R_2$ to $R_5$ is $SO_3M$; and M=hydrogen or a non-chromophoric cation.

6. A liquid detergent composition according to claim 1, which comprises a fluorescent whitening agent of formula (1), wherein $R_4$=$SO_3M$, $R_1$, $R_2$, $R_3$ and $R_5$ are each independently of one another hydrogen, $C_1$–$C_4$alkyl, $C_1$–$C_4$alkoxy, halogen, CN, phenoxy or benzyloxy; and M=hydrogen or a non-chromophoric cation.

7. A liquid detergent composition according to claim 6, which comprises a fluorescent whitening agent of formula (1), wherein $R_4$=$SO_3M$ $R_1$, $R_2$, $R_3$ and $R_5$ are each independently of one another hydrogen, methyl, ethyl, isopropyl, tert-butyl, methoxy, chloro, CN, phenoxy or benzyloxy, and M=hydrogen or a non-chromophoric cation.

8. A liquid detergent composition according to claim 7, which comprises a fluorescent whitening agent of formula (1), wherein $R_4$=$SO_3M$ $R_1$, $R_2$, $R_3$ and $R_5$ are each independently of one another hydrogen, methyl, ethyl, isopropyl, tert-butyl or chloro; and M=hydrogen or a non-chromophoric cation.

9. A liquid detergent composition according to claim 1, which comprises a fluorescent whitening agent of formula (1), wherein $R_2$=$SO_3M$, $R_1$, $R_3$, $R_4$ and $R_5$ are each independently of one another hydrogen, $C_1$–$C_4$alkyl, $C_1$–$C_4$alkoxy, halogen, CN, phenoxy or benzyloxy; and M=hydrogen or a non-chromophoric cation.

10. A liquid detergent composition according to claim 9, which comprises a fluorescent whitening agent of formula (1), wherein $R_2$=$SO_3M$ $R_l$, $R_3$, $R_4$ and $R_5$ are each independently of one another hydrogen, methyl, ethyl, isopropyl, tert-butyl, methoxy, chloro, CN, phenoxy or benzyloxy, and M=hydrogen or a non-chromophoric cation.

11. A liquid detergent composition according to claim 10,, which comprises a fluorescent whitening agent of formula (1), wherein $R_2$=$SO_3M$ $R_1$, $R_3$, $R_4$ and $R_5$ are each independently of one another hydrogen, methyl, ethyl, isopropyl, tert-butyl or chloro; and M=hydrogen or a non-chromophoric cation.

12. A liquid detergent composition according to claim 1, which comprises a fluorescent whitening agent of formula

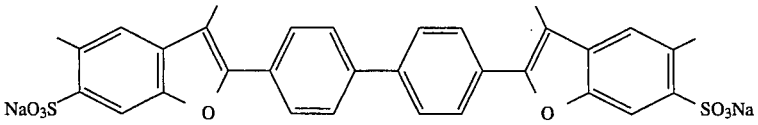

(2)

13. A liquid detergent composition according to claim 1, which comprises a fluorescent whitening agent of formula

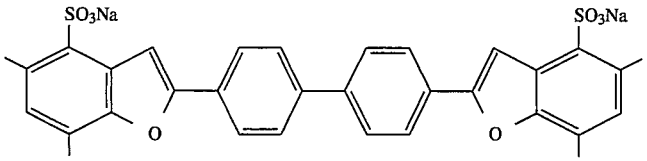

(3)

14. A liquid detergent composition according to claim 2, wherein M is sodium, potassium or ammonium.

15. A liquid detergent composition according to claim 1, which comprises 8 to 17% by weight of water, based on the weight of the detergent composition.

16. A liquid detergent composition according to claim 1, which comprises 0.02 to 0.4% by weight, based on the weight of the detergent composition, of one or more than one fluorescent whitening agent of formula (1).

17. A method for washing and pretreating textile fabrics, comprising contacting them with a liquid detergent composition as claimed in claim 1.

18. A process for the preparation of a liquid detergent composition as claimed in claim 1, which comprises mixing and homogenising fluorescent whitening agent, surfactants, auxiliaries and builders, an optional bleaching system, and water.

19. A method for washing textile fabrics, comprising contacting them with a liquid detergent composition as claimed in claim 1.

* * * * *